US005435621A

United States Patent [19]

Komorowski et al.

[11] Patent Number: 5,435,621

[45] Date of Patent: Jul. 25, 1995

[54] MODULAR RECLINING CHAIR AND METHOD

[75] Inventors: Karl J. Komorowski, Petersburg; Larry P. LaPointe, Temperance; Jonathan R. Saul, LaSalle, all of Mich.

[73] Assignee: La-Z-Boy Chair Company, Monroe, Mich.

[21] Appl. No.: 100,916

[22] Filed: Aug. 9, 1993

Related U.S. Application Data

[63] Continuation-in-part of Ser. No. 40,005, Apr. 9, 1993, which is a continuation-in-part of Ser. No. 772,231, Oct. 11, 1991, Pat. No. 5,301,413.

[51] Int. Cl.[6] ..... A47C 1/02

[52] U.S. Cl. ..... 297/84; 297/85; 297/440.21; 29/436

[58] Field of Search ..... 297/85, 83, 259, 317, 297/322, 329, 271, 342, 440.21, 452.18, DIG. 7; 29/91, 91.1, 434, 436

[56] References Cited

U.S. PATENT DOCUMENTS

| | | | |
|---|---|---|---|
| 1,048,306 | 12/1912 | Greilick . | |
| 3,096,121 | 7/1963 | Knabusch et al. . | |
| 3,869,169 | 3/1975 | Johnson et al. . | |
| 4,179,157 | 12/1979 | Shoemaker et al. . | |
| 4,367,895 | 1/1983 | Pacitti et al. . | |
| 5,141,284 | 8/1992 | LaPointe | 297/329 X |
| 5,184,712 | 2/1993 | LaPointe et al. | 297/440.21 |
| 5,217,276 | 6/1993 | LaPointe et al. | 297/85 |
| 5,222,286 | 6/1993 | Saul et al. | 297/83 X |
| 5,271,660 | 12/1993 | LaPointe et al. | 297/85 |
| 5,288,126 | 2/1994 | Saul et al. | 297/85 |

*Primary Examiner*—Laurie K. Cranmer
*Attorney, Agent, or Firm*—Harness, Dickey & Pierce

[57] ABSTRACT

A modular reclining chair and method for assembling it are disclosed. The modular reclining chair includes a simplified actuation mechanism which significantly reduces system complexity and weight while providing improved comfort to the seat occupant. The construction is such that the pre-assembled actuation mechanism is integrally suspended from and interdependent with modular frame components, and included among the modular frame components is a front cross rail assembly.

18 Claims, 11 Drawing Sheets

FIG 11
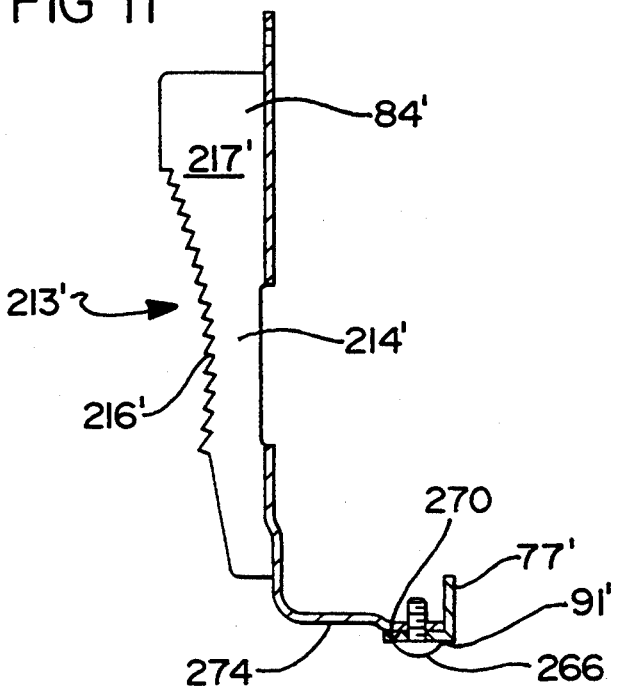
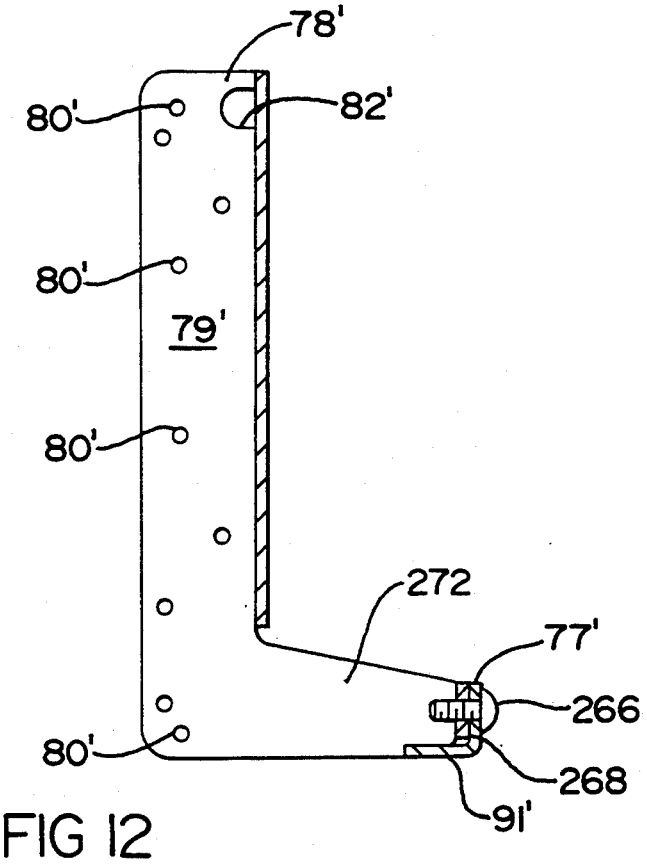
FIG 12

MODULAR RECLINING CHAIR AND METHOD

CROSS REFERENCE TO RELATED APPLICATIONS

This application is a continuation-in-part of application Ser. No. 08/040,005 filed Apr. 9, 1993 which is a continuation-in-part of U.S. application Ser. No. 07/772,231, filed Oct. 11, 1991, now U.S. Pat. No. 5,301,413.

BACKGROUND OF THE INVENTION

The present invention relates generally to reclining chairs and, more particularly, to a method for assembling an improved reclining chair from pre-assembled modular components.

Traditionally, reclining chairs are equipped with an actuation mechanism which is operatively interconnected between a prefabricated chair frame and a stationary base assembly. In general, the actuation mechanism is a combination of various mechanical linkages operable for providing various comfort features such as independent reclining movement of a seat assembly as well as actuation of an extensible leg rest assembly. Due to its relative complexity, it is common practice in the furniture industry to assemble the various mechanical linkages of the actuation mechanism into a stand alone mechanism frame assembly. A prefabricated U-shaped chair frame is frequently bolted around the mechanism frame assembly with the open portion of the "U" corresponding to the front of the chair. In addition, the seat assembly is supported from the mechanism frame assembly for reclining movement with respect to the chair frame. Accordingly, such reclining chairs having a mechanism frame assembly within a wood chair frame are commonly referred to as having a "frame within a frame" construction. As such, most furniture manufacturers do not upholster the exterior surfaces of the prefabricated chair frame until after the mechanism frame assembly has been installed. Unfortunately, the upholstering operation is very inefficient and expensive in that the frequently heavy and cumbersome prefabricated chair frame must be manually manipulated in an extremely labor-intensive manner.

Pursuant to traditional reclining chair construction technique, the free ends of the U-shaped frame are attached on opposite sides at the front of the mechanism frame assembly. However, the conventional mechanism frame assembly typically comprises a narrow rail as the front frame member in order to prevent interference with the pantograph linkage that protrudes from the front of the chair during extension and retraction of the leg rest member. Accordingly, due to the small connection surface between the free ends of the U-shaped chair frame and the front member of the mechanism frame assembly, the free ends of the U-shaped chair frame, which typically comprise chair arms, are susceptible to an undesirable degree of lateral deflection when side-to-side pressure is applied to the chair arms.

While many conventional reclining chairs operate satisfactorily, furniture manufacturers are continually striving to develop improved frames and actuation mechanisms for reducing system complexity and increasing structural soundness and smoothness of operation as well as occupant comfort. Furthermore, there is a continuing desire to develop improved fabrication and assembly techniques which will result in reduced costs while promoting increased efficiency and improved product quality.

SUMMARY OF THE INVENTION

In accordance with the principles of the present invention, an improved method for assembling an article of furniture is disclosed which is designed to overcome the disadvantages traditionally associated with fabricating, assembling and upholstering reclining-type chairs. Therefore, a primary object of the present invention is to provide a reclining chair which can be simply, efficiently, and rigidly assembled so as to significantly reduce its overall complexity, weight, and cost while providing improved operation and comfort to the seat occupant.

It is an additional object of the present invention to provide a three-way reclining chair which is adapted to permit selective and independent "reclining" movement of a seat back relative to a seat member as well as actuation (i.e. extending and retracting) of a leg rest assembly. As such, the present invention provides a reclining chair wherein the minimal force achieved via shifting the weight of the seat occupant is utilized as the primary means for moving the seat assembly between an "upright" position and a "reclined" position.

It is another object of the present invention to reduce the input force exerted by the seat occupant for smoother operation of the actuation mechanism. As a related object, the complexity of improved actuation mechanism has been significantly simplified to incorporate mechanical linkage and drive components optimally designed for substantially reducing frictional losses so as to promote easier and smoother actuation. Moreover, the various operative linkages are designed to permit "pre-assembly" of the actuation mechanism without utilization of a conventional mechanism frame assembly.

It is still another object of the present invention to provide a simplified recliner chair frame which is structurally rigid, easy to assemble, and reduces lateral or "side-to-side" deflection of the chair arms.

In a preferred embodiment of the present invention, the integrated or "knock-down" construction of the reclining chair facilitates application of unique fabrication and assembly techniques which effectively result in increased production efficiency and cost savings while concomitantly producing a high-quality article of furniture. In general, the construction of the reclining chair is such that the pre-assembled actuation mechanism cannot be divorced from the pre-upholstered frame components which, when assembled, are rigidly interconnected to define a "box-like" chair frame or body from which the pre-assembled actuation mechanism is integrally suspended. In this manner, the conventional construction of supporting the actuation mechanism within a separate and distinct mechanism frame assembly is no longer required. The pre-assembled actuation mechanism includes a drive rod and a front support shaft which are each directly supported between left and right upholstered side frame assemblies. As such, extremely precise alignment of the actuation mechanism with respect to each of the separate upholstered side frame assemblies is possible. Moreover, unique front and rear frame rail members interconnect the left and right side frame assemblies to define a "unitized" and extremely rigid box-like chair frame or body for inhibiting side-to-side flexion of the actuation mechanism suspended therein as well as of the side frame assemblies themselves. In addition to the structural and functional advantages associated with the modular reclining chair of the present invention, a unique method of assembling the pre-assembled actuation mechanism as an integrated component within the frame components is disclosed.

The leg rest assembly may be operated by the seat occupant rotating an actuator lever through a limited angle which, in turn, rotates the drive rod for selectively extending or retracting a pair of leg rest pantograph linkages. The pantograph linkages are uniquely suspended for synchronous actuation between the drive rod and the front support shaft and protrude through apertures provided in the front frame rail member. In addition, an over-centered toggle mechanism is provided to assist in extending and retracting the leg rest assembly and in retaining the leg rest assembly in its "extended" and "stowed" positions.

Furthermore, the present invention relates to an improved combination reclining and platform rocking chair which can be used as a conventional rocker or as a reclining chair. The combination reclining/tilt chair is constructed and balanced such that normal rocking movement between the chair body and the stationary base assembly is permitted without causing the seat assembly to recline, but which can be quickly and easily reclined when desired. In addition, latching means are provided for permitting the seat occupant to selectively "lock" the chair body in a multitude of rearwardly "tilted" positions to arrest the rocking action upon initial extension of the leg rest assembly to its extended position. Independent of such action, slight backward pressure applied to the seat back is operable to initiate reclining movement of the seat assembly. Accordingly, an infinite number of reclined positions may be achieved upon the seat occupant shifting his or her body weight against the seat back. Additional objects, advantages, and features of the present invention will become apparent from the following description and appended claims, taken in conjunction with the accompanying drawings.

DESCRIPTION OF THE DRAWINGS

FIG. 11 is a sectional view taken along line 11—11 of FIG. 10; and

FIG. 12 is a sectional view taken along line 12—12 of FIG. 10.

DETAILED DESCRIPTION OF THE INVENTION

In accordance with the teachings of the present invention, an improved actuation mechanism for use in single and multi-person articles of furniture (i.e. chairs and sofas or loveseats) is disclosed. In addition, the present invention is also directed to a method of assembling the improved actuation mechanism as a pre-assembled and "integrated" component of a reclining-type chair or the like. As will be described, the pre-assembled actuation mechanism is uniquely suspended in a "fixed" three-pivot-point arrangement from the frame components so as to provide precise mechanical alignment and superior structural rigidity while concomitantly facilitating application of highly efficient fabrication and assembly processes. The actuation mechanism of the present invention is a "three-way" mechanism which can be actuated to independently "recline" a seat back relative to a seat member or move a leg rest assembly between "retracted" and "extended" positions. Moreover, a full range of independent "reclining" movement of the seat back relative to the seat member is possible regardless of the operative position of the leg rest assembly between its fully "retracted" and "extended" positions.

In the disclosed embodiment, the article of furniture is shown as a combination recliner and platform rocker, hereinafter referred to reclining/rocking chair 10, which includes a pre-assembled actuation mechanism 12 and various upholstered frame components that can be quickly and simply modularly assembled as a seating unit. Such "modular" construction provides a significant advancement over conventional furniture fabrication and assembly techniques since manipulation of heavy and cumbersome chair frames during upholstery installation is no longer required. As such, the frame components can be upholstered prior to modular assembly to actuation mechanism 12 so as to improve individual component quality as well as overall system quality and production efficiency. Alternatively, the frame components can be adapted to accept upholstered trim panels following modular assembly. Moreover, since actuation mechanism 12 of the present invention is relatively compact in size, the use of loose upholstered cushions, which is an important feature in marketing various styles of chair, sofa or loveseat furniture, is also possible.

Figure 1A:
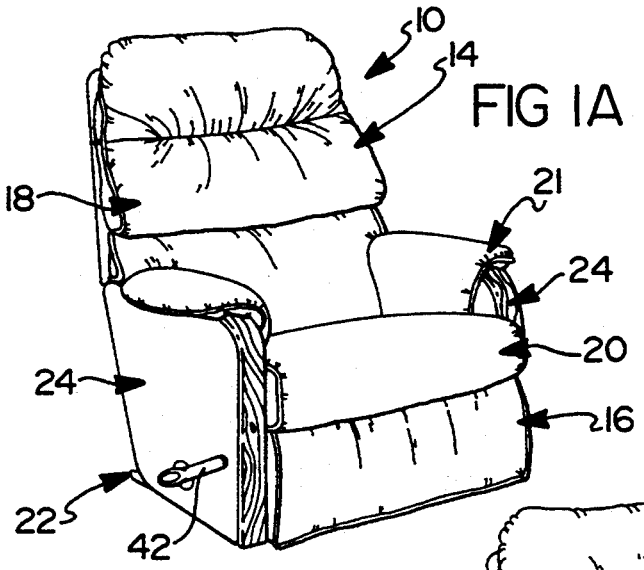
FIGS. 1A through 1D are perspective views of an exemplary reclining chair apparatus shown in various operative positions, the "modular" components of which have been fabricated and assembled in accordance with the principles of the present invention.
Figure 1B:
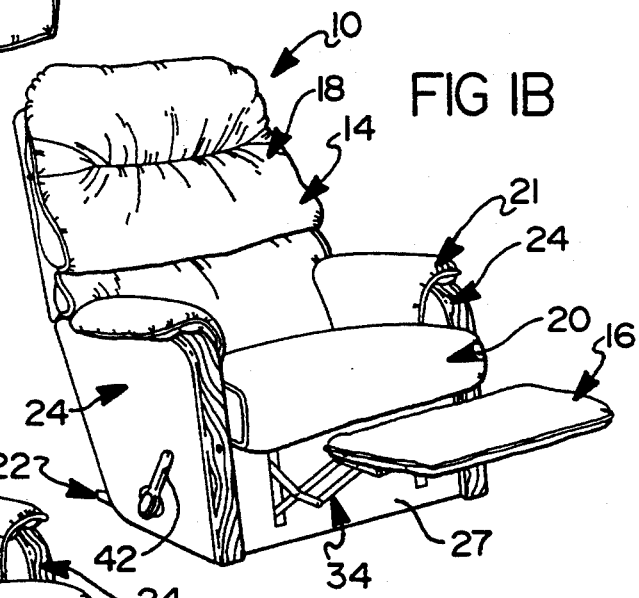
Figure 1C:
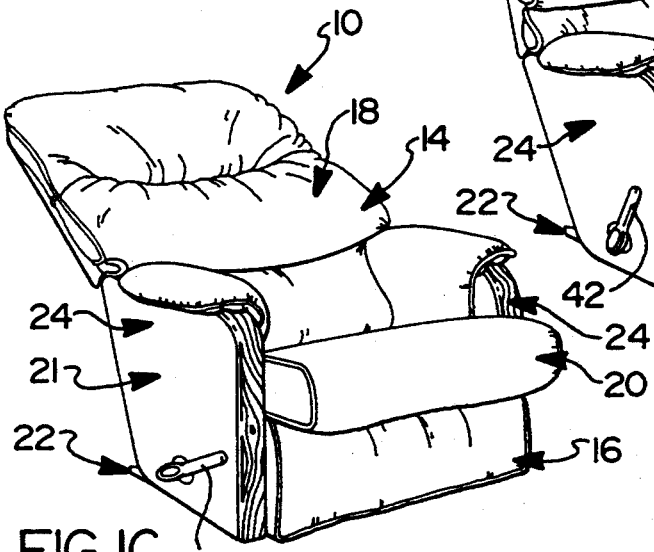
Figure 1D:
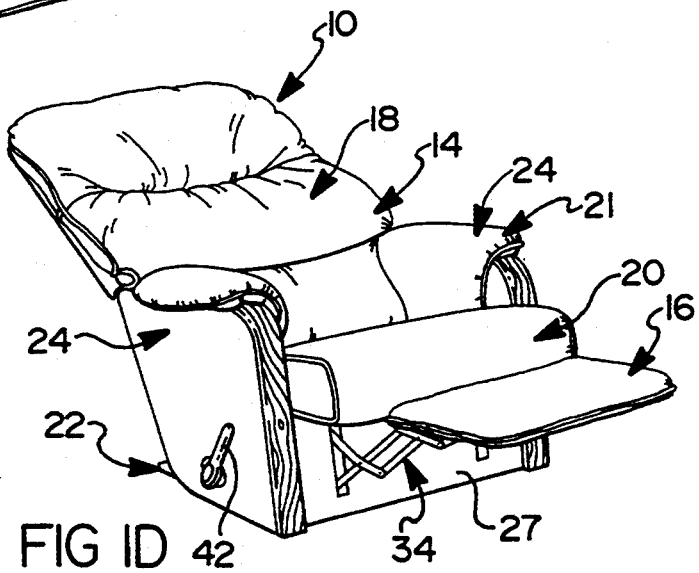

With particular reference now to the drawings, the functional and structural aspects of actuation mechanism 12, shown operably suspended from the frame components of recliner/rocker chair 10, will now be described. More particularly, FIG. 1A depicts an exemplary combination reclining/rocking chair 10 having its seat assembly 14 shown in a fully "upright" position for permitting a seat occupant to enjoy conventional seating. FIG. 1B illustrates reclining/rocking chair 10 in the "upright" position with its associated leg rest assembly 16 shown protracted to its "extended" position. As seen in FIG. 1C, seat assembly 14 includes a seat back 18 shown in a "reclined" position relative to a seat 20 while leg rest assembly 16 is positioned in its retracted or "stowed" position. As is known, reclining movement of seat assembly 14 is accomplished by the seat occupant deliberately applying pressure to seat back 18 such that a seat swing mechanism causes seat member 20 to move forwardly and upwardly for maintaining seating comfort while the included angle increases therebetween. Chair 10 may be easily returned to its "upright" position upon deliberate application of rearward pressure to seat assembly 14 or, more simply, if the seat occupant leans forward to remove pressure from seat back 18. Finally, FIG. 1D shows seat assembly 14 of chair 10 in the "reclined" position with its respective leg rest assembly 16 protracted to the "extended" position. In accordance with the embodiment shown, and as will be described from the following disclosure, the entire chair body 21 can be easily "rocked" with respect to stationary base assembly 22.

Figure 2:
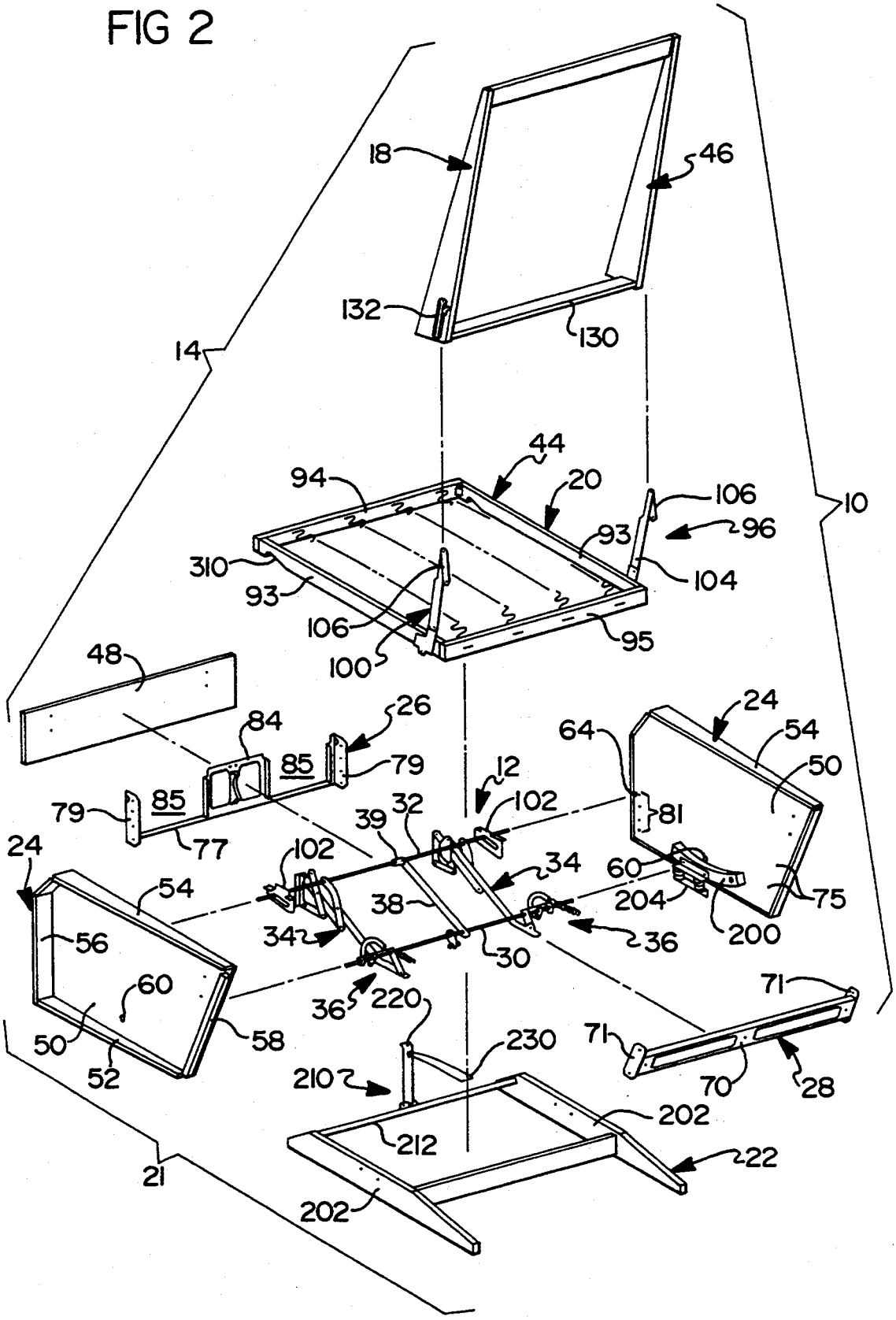
FIG. 2 is an exploded perspective view of a reclining chair of the type shown in FIG. 1 with upholstery, springs and other parts removed from the frame components for illustrating their integrated and interdependent association with an improved actuation mechanism.

In accordance with a primary design feature of the present invention, the various pre-assembled frame components provided for operably suspending actuation mechanism 12 within reclining/rocking chair 10 will now be clearly described. For purposes of clarity, FIG. 2 shows the various pre-assembled frame components with their upholstery, padding, springs, etc. removed to better illustrate the interdependency of the frame components construction which can be rapidly and rigidly assembled in a relative easy and efficient manner. Therefore, all of the frame components can be individually fabricated or sub-assembled to include the requisite brackets, springs, padding and upholstery on an "off-line" batch-type basis. Thereafter, the various pre-assembled frame components are modularly assembled for totally integrating actuation mechanism 12 therein.

As seen in FIGS. 2 through 8, actuation mechanism 12 of reclining/rocking chair 10 is integrated into and operably suspended from left and right side frame assemblies 24. In addition to side frame assemblies 24, reclining/rocking chair 10 also includes front and rear frame rail members 26 and 28, respectively, which when interconnected define a rigid "box-like" chair frame. As will be described in greater detail hereinafter, actuation mechanism 12 is pre-assembled to include a drive rod 30 and front support shaft 32, both of which are spatially oriented to be precisely located and "suspended" from left and right side frame assemblies 24.

With continued reference to FIGS. 2 through 8, actuation mechanism 12 is shown to support leg rest assembly 16 thereon. More specifically, leg rest assembly 16 includes left and right pantograph linkage mechanisms 34 and left and right spring-assisted toggle mechanisms 36 which are operably associated with drive rod 30 and front support shaft 32 for permitting the seat occupant to selectively actuate leg rest assembly 16. A rigid cross-brace 38 is secured between drive rod 30 and support shaft 32 for providing structural rigidity within actuation mechanism 12. More particularly, one end of cross-brace 38 is journally supported on drive rod 30 while the opposite end thereof is configured as a bracket 39 which is fixedly secured (such as by suitable threaded fasteners) to a central portion of support shaft 32 and front frame rail member 26. Thus, support shaft 32 is rigidly fixed to cross-brace 38 and front frame rail member 26 to inhibit rotation of support shaft 32 upon rotation of drive rod 30. In the preferred construction, drive rod 30 is an elongated square shaft having a handle portion 42 provided adjacent an upholstered exterior portion of one of side frame assemblies 24 that can be easily reached by a person seated in chair 10 for convenient actuation thereof.

As best seen in FIG. 2, most of the structural frame components such as side frame assemblies 24, front frame rail member 26, rear frame rail member 28, seat frame 44, seat back frame 46 and leg rest frame board 48 are each fabricated and/or constructed in a manner which enables them to support springs, padding, upholstery, etc. in order to complete a decorative and stylish reclining/rocking chair 10 similar to that shown in FIGS. 1A through 1D. As previously noted, the various frame components can be individually pre-assembled and upholstered for subsequent assembly into a modular chair 10. Alternatively, means can be provided for securing upholstered trim panels to the frame components following modular assembly of chair body 21. For example, an upholstered front trim panel 27 is shown in FIGS. 1B and 1D mounted to front frame rail member 26. However, it is to be understood that the specific construction shown for each frame component is merely exemplary in nature.

Left and right side frame assemblies 24 are each constructed as rigid, roughly rectangular wooden frame components having a universal side panel 50 and horizontal bottom and top members 52 and 54, respectively, with top members 54 also functioning as chair arms. Each side frame assembly 24 also includes a front post 56 which preferably has at least a lower portion substantially perpendicular to the floor. In addition, each side frame assembly 24 has an inclined rear post member 58 such that front and rear posts 56 and 58, respectively, and top and bottom horizontal members 54 and 52, respectively, are each rigidly secured to a side panel 50. Moreover, side panels 50 have a first set of aligned bores 60 formed therein that are sized to receive opposite ends of drive rod 30. In addition, sleeve journals 62 are retained within bores 60 and are sized to permit rotation of drive rod 30. As such, aligned bores 60 define a first set of "fixed" pivot or suspension points that are seated directly within side panels 50. In this manner, drive rod 30 has a fixed pivot arrangement and not a conventional "floating" type which typically requires additional linkages.

A second set of aligned bores 64 are formed in close proximity to a front edge of side panels 50 for receiving opposite ends of support shaft 32 therein. Preferably, aligned bores 60 are "blind bores" which do not extend completely through side panels 50 to assist in properly aligning (i.e., centering) support shaft 32 within chair 10 upon final assembly. Alternatively, scab blocks (not shown) could be secured to an exterior surface of side panels 50 to interrupt aligned bores 64 if they are originally drilled as "through bores" in side panels 50. In either case, aligned bores 64 are seated directly in side panels 50 to define a second set of "fixed" pivot or suspension points. Since the first and second sets of aligned bores 60 and 64, respectively, are oriented in a predetermined arrangement on side panels 50, it is apparent that all critical hole locations for left and right side panels 50 may be drilled in a single operation. Therefore, pre-assembly of actuation mechanism 12 facilitates "final" assembly of chair 10 since drive rod 30 and support shaft 32 are oriented for receipt within aligned bores 60 and 64, respectively. Side panels 50 do not become "left" or "right" until the members 52, 54, 56, and 58 are affixed and sleeve journals 62 are installed in aligned bores 60. By thus providing side panels 50 as a universal component, the accuracy of locating aligned bores 60 and 64 is greatly enhanced.

As noted, front frame rail member 26 and rear frame rail member 28 are adapted to be rigidly secured to side frame assemblies 24 for integrally suspending actuation mechanism 12 within a rigid "box-like" chair frame 21. In general, front frame rail member 26 and rear frame rail member 28 are each fabricated as non-wooden components which provide superior strength and rigidity while concomitantly reducing the weight, cost and pre-assembly requirements over their wooden counterparts. In the preferred embodiment shown, front frame rail member 26 and rear frame rail member 28 are stamped metal components. As best seen from FIGS. 5 and 6, rear frame rail member 28 is shown as a one-piece metal stamping having a cross-member segment 70 and a pair of angled bracket segments 71 formed at the opposite ends of cross-member segment 70. In addition, upper and lower angled flange segments 72 and 73, respectively, are formed to extend transversely from cross-member segment 70 and have end surfaces that abuttingly engage the interior surface of angled bracket segments 71. As such, rear frame rail member 28 is a box-like reinforced structural frame component that is adapted to inhibit "side-to-side" lateral play of the rear portion of box-like chair frame 21. To provide means for securing rear frame rail member 28 to side frame assemblies 24, a pair of bores 74 are formed in each angled bracket segment 71 such that suitable fasteners can be used for fixedly securing angled bracket segments 71 and, in turn, rear frame rail member 28 directly to the inner surface of side panels 50. Preferably, alignment bores 75 are pre-drilled into side panels 50 for receiving threaded fasteners therein to rigidly secure rear frame rail member 28 between the left and right side frame assemblies 24. Typically, an upholstered rear "tailgate" (not shown) is mounted to cross-member segment 70 following modular assembly of chair 10 since rear frame rail member 28 is not generally upholstered prior to assembly between side frame assemblies 24. To provide means for mounting the upholstered rear tailgate to rear frame rail member 28, one or more mounting apertures 76 are formed in cross-member segment 70 to accept a suitable push-in type retainer clip extending from the rear tailgate. Thereafter, upholstered tabs extending from the rear tailgate may be stapled to side panels 50.

Figure 4:
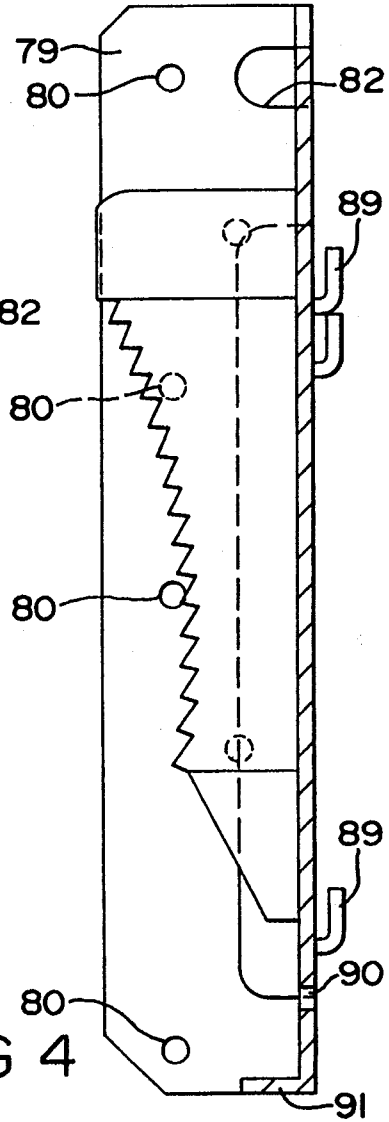
FIG. 4 is an enlarged sectional view of the front frame rail member taken along line 4—4 of FIG. 3.
Figure 3:
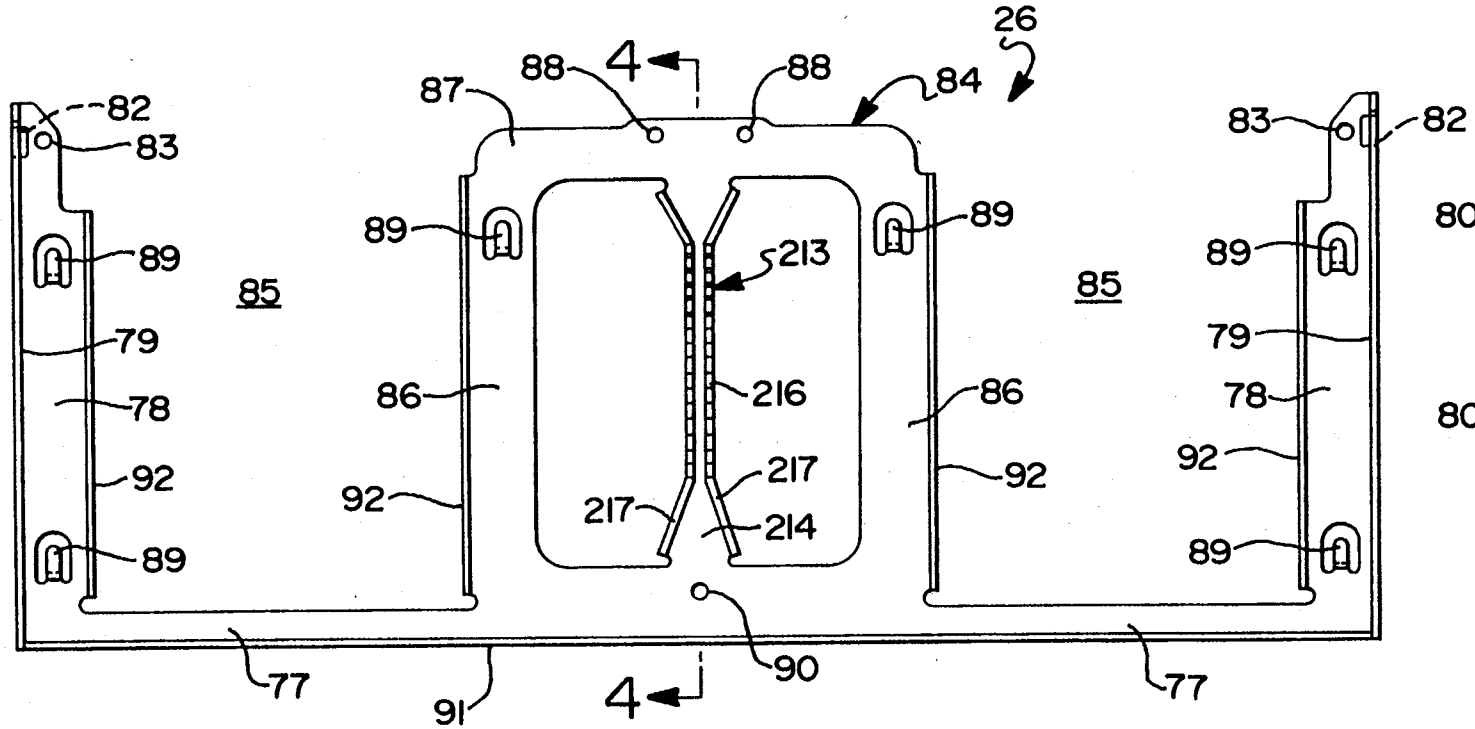
FIG. 3 is a rear view of the front frame rail member shown in FIG. 2.
Figure 5:
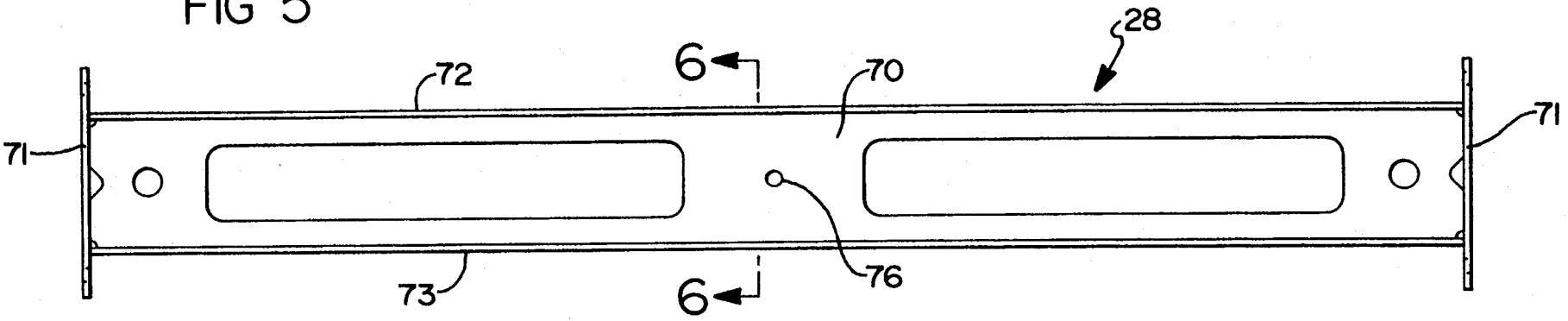
FIG. 5 is a front view of the rear frame rail member shown in FIG. 2.
Figure 6:
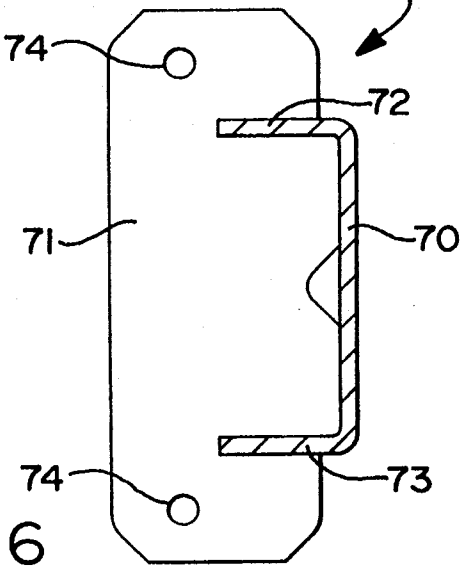
FIG. 6 is a sectional view taken along line 6—6 of FIG. 5.

With particular reference to FIGS. 2 through 4, front frame rail member 26 is shown in a first preferred embodiment as a one-piece metal stamping having a lower cross-member segment 77 and a pair of end segments 78 extending upwardly from opposite lateral ends of cross-member segment 77 and which are generally coplanar therewith. In addition, an outer flanged bracket segment 79 extends transversely from each end segment 78 and includes a series of bores 80 which are alignable with a series of bores 81 formed in side panels 50 for rigidly securing front frame rail member 26 between side frame assemblies 24. In addition, each flanged bracket segment 79 also includes a guide slot 82 for retaining and locating opposite end portions of support shaft 32 thereon. As noted, the front face of each end segment 78 is coplanar with lower cross-member segment 77 and includes a bore 83 which is aligned in a common horizontal plane with guide slots 82. Bores 83 are provided for fixing end segments 78 of front frame rail member 26 to end portions of support shaft 32. An upwardly extending central segment 84 is integrally formed to extend from a central portion of lower cross-member segment 77 and which cooperates with the laterally-spaced end segments 78 for defining a pair of enlarged open-ended apertures 85. As will be appreciated, apertures 85 permit leg rest pantograph linkages 34 to move therethrough during extension and retraction of leg rest assembly 16. Central segment 84 has a pair of laterally-spaced and symmetrical cut-outs for defining a pair of vertical extending side segments 86 that are interconnected by a horizontal top segment 87. A pair of bores 88 are formed in top segment 87 in alignment with bores 83 on end segments 78 for fixing central segment 84 of front frame rail member 26 to a central portion of support shaft 32 and bracket portion 39 of cross-brace 38.

Figure 7:
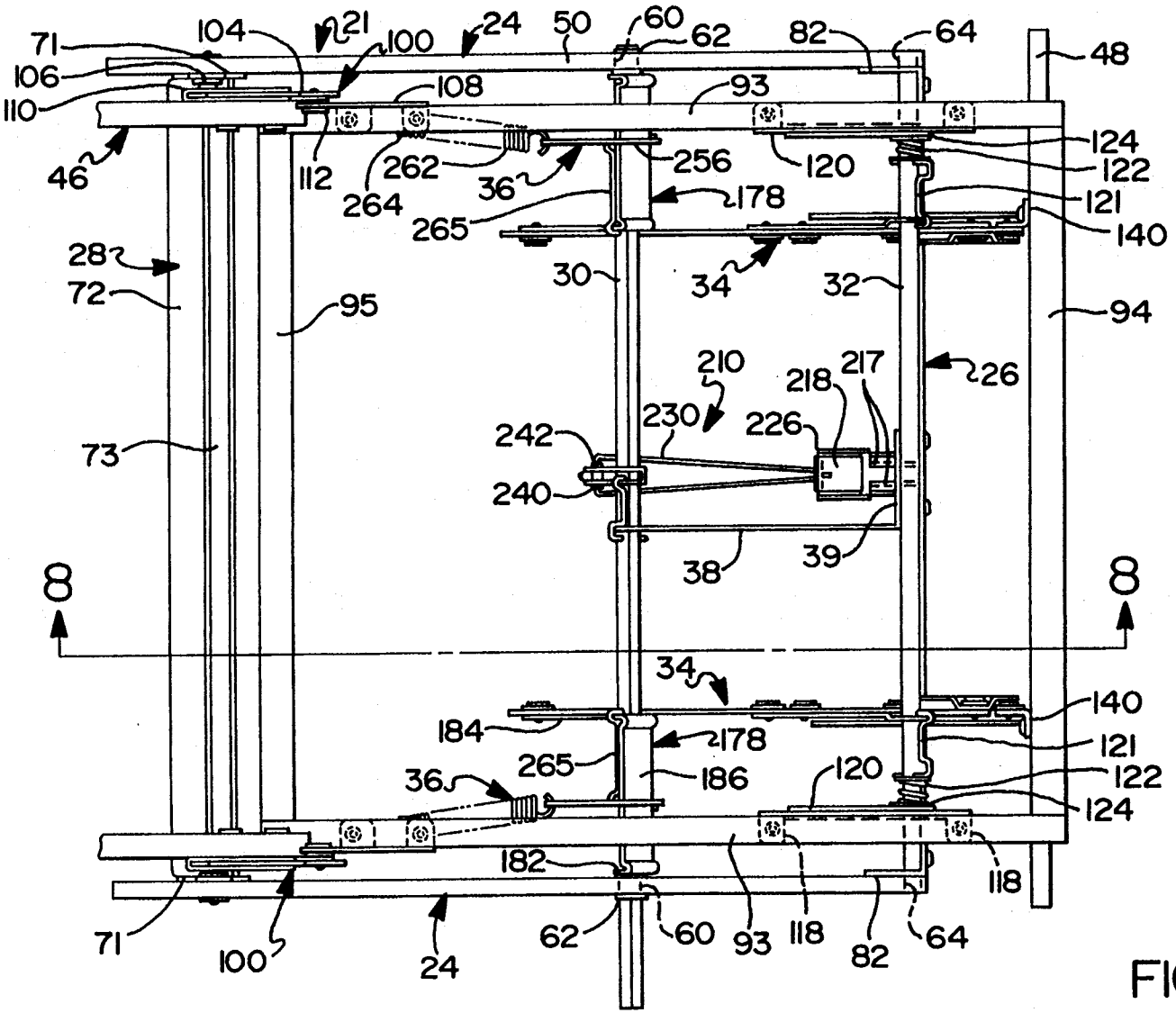
FIG. 7 is a partial plan view of the reclining chair shown in FIG. 2.
Figure 8:
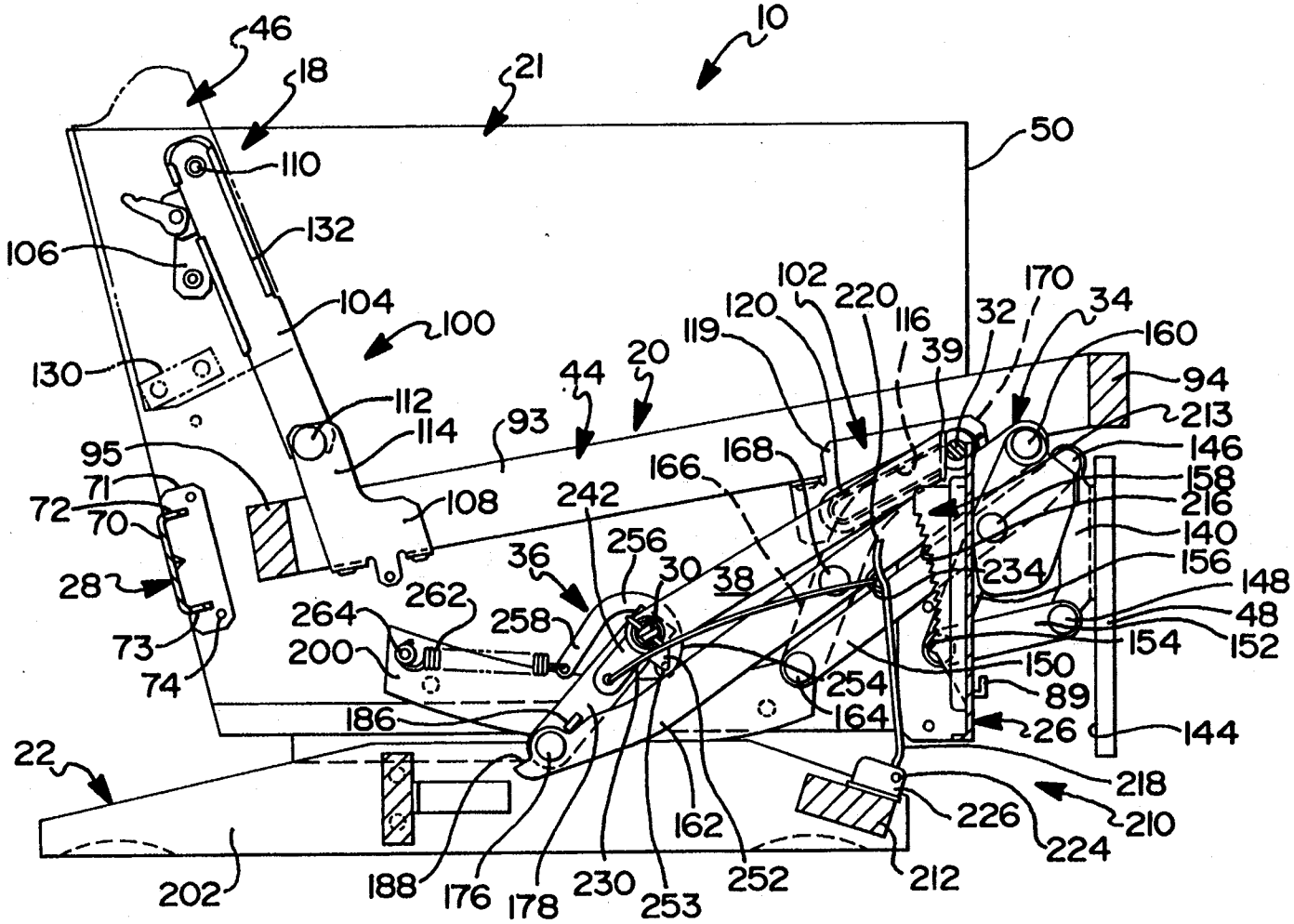
FIG. 8 is an enlarged sectional view taken along line 8—8 of FIG. 7, illustrating the reclining chair in an "upright" position.

Preferably, support shaft 32 is pre-drilled with four bores which are alignable with bores 83 and 88 formed in front frame rail member 26 for receiving threaded fasteners therein to rigidly secure support shaft 32 directly to front frame rail member 26. As such, support shaft 32 is non-rotatably fixed to front frame rail member 26 and acts as an upper cross-member for providing superior rigidity to the front portion of chair frame 21. In addition, the exterior surface of front frame rail member 26 (as defined by the coplanar end segments 78, central segment 84 and lower cross-member segment 77) is adapted to be mounted substantially flush with the front edge of side panels 50. Such a flush mounting arrangement is more compact than traditionally associated with conventional chair frames and provides adequate clearance with respect to leg rest frame board 48 for accommodating a center or "pop-up" ottoman frame board (not shown) therebetween if leg rest assembly 16 is so equipped. FIG. 7 and 8 clearly illustrate the available clearance space between front frame rail member 26 and leg rest frame board 48 for accommodating such an ottoman frame board therebetween when leg rest assembly 16 is in its retracted position. Hook-type clips 89 are formed from a series of small cut-outs in end segments 78 and side segments 86 of central segment 84 for mounting front upholstered tailgate 27 to front frame rail member 26. In addition, a mounting bore 90 is provided for receiving a push-in retainer clip (not shown) which extends from front tailgate 27. To provide superior structural rigidity, front frame rail member 26 also includes a lower horizontal flange 91 extending transversely to lower cross-member segment 77 with its opposite edge surfaces adapted to abuttingly engage the interior surface of flanged bracket segments 79. In addition, vertical flanges 92 are shown formed on end segments 78 and side segments 86 for providing still further structural rigidity.

Figure 10:
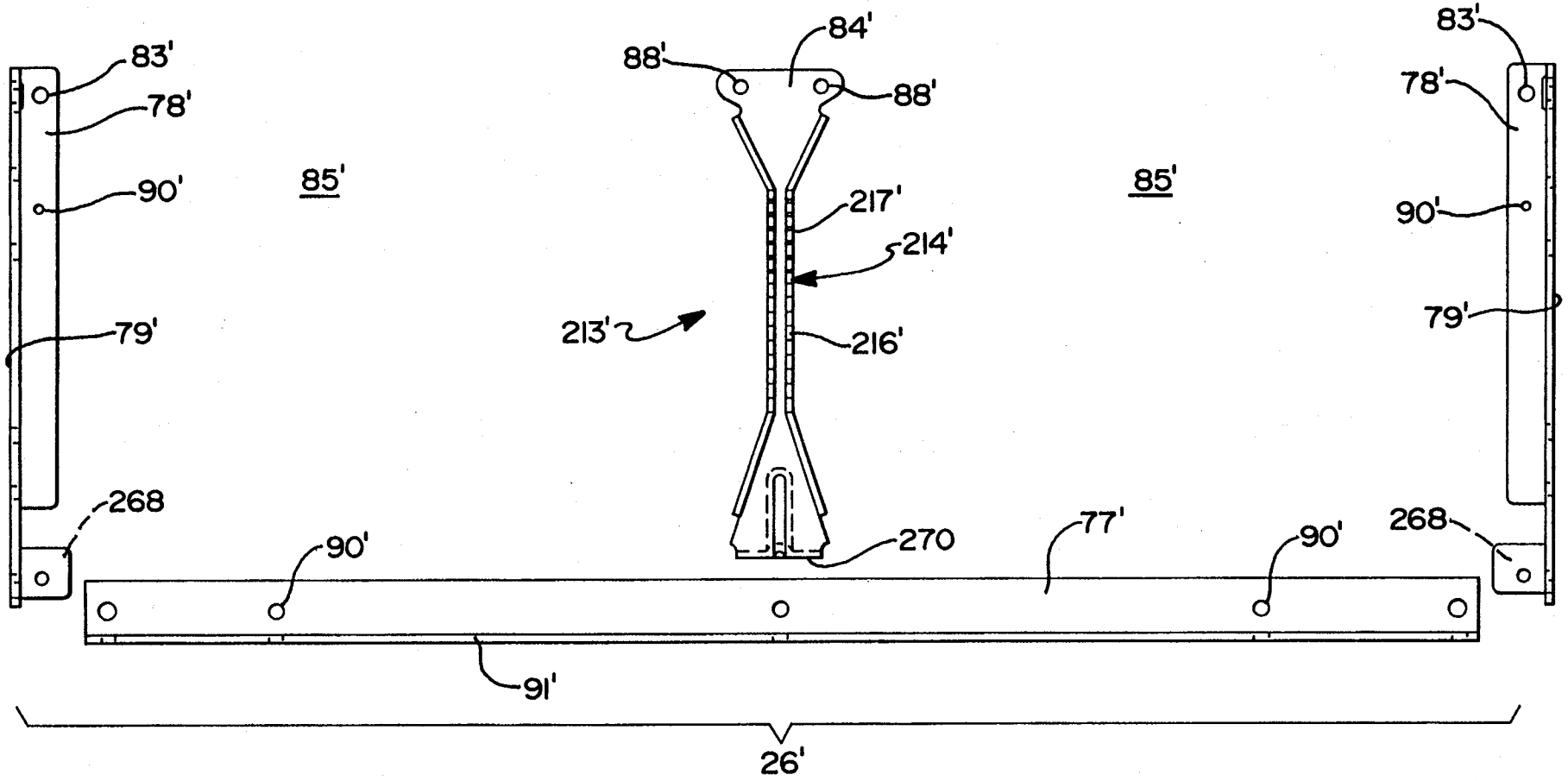
FIG. 10 is an exploded rear view of a front frame rail assembly which may be substituted for the front frame rail shown in FIG. 3.

With reference now to FIGS. 10–12, a second preferred embodiment of the front frame rail is shown. Primed reference numerals are used to identify similar elements to those found in the first embodiment of the front frame rail member. As can be seen from FIG. 10, front frame rail assembly 26' is a multi-piece assembly including lower cross-member segment 77', end member segments 78' extending upwardly from opposite lateral ends of cross-member segment 77' and which are substantially parallel to, but laterally displaced from, cross-member segment 77'. Central segment 84' is also provided and secured substantially midway between end member segments 78'. End member segments 78' and central segment 84' are rigidly secured to lower cross-member segment 77' by, for example, threaded fasteners 266. It should be understood, however, that any suitable means for fastening, such as by welding, riveting, or the like, may be used to secure the front frame rail assembly 26' together. It should also be appreciated that end member segments 78' and central segment 84' are formed with mounting surfaces 268 and 270, respectively, for engaging lower cross-member segment 77' such that a minimum number of fasteners, and in the preferred embodiment only three threaded fasteners 266, are required to rigidly secure the assembly together.

End member segments 78' are formed with an outer flanged bracket segment 79' which extend transversely from each end segment 78' and includes a series of bores 80' which are alignable with a series of bores 81 formed in side panels 50 for rigidly securing front frame rail assembly 26' between side frame assemblies 24. In addition, each flanged bracket segment 79' also includes a guide slot 82' for retaining and locating opposite end portions of support shaft 32 thereon. As noted, the front face of each end segment 78' is generally parallel to but laterally displaced from lower cross-member segment 77' and includes a bore 83' which is aligned in a common horizontal plane with guide slots 82'. Bores 83' are provided for fixing end segments 78' of front frame rail assembly 26' to end portions of support shaft 32.

Central segment 84' cooperates with the laterally-spaced end segments 78' for defining a pair of enlarged open-ended apertures 85' for permitting leg rest pantograph linkages 34 to move therethrough during extension and retraction of leg rest assembly 16. A pair of bores 88' are formed in top segment 87' for fixing central segment 84' of front frame rail assembly 26' to a central portion of support shaft 32 and a bracket portion 39 of cross-brace 38.

As previously discussed, support shaft 32 is preferably pre-drilled with four bores which are alignable with bores 83' and 88' formed in end member segments 78' and central segment 84', respectively, for receiving threaded fasteners therein to rigidly secure support shaft 32 directly to front frame rail assembly 26'. As such, support shaft 32 is non-rotatably fixed to front frame rail assembly 26' and acts as an upper cross-member for providing superior rigidity to the front portion of chair frame 21. As can be further appreciated, forming lower cross-member segment 77', end members segments 78' and central segment 84' as separate pieces greatly reduces the complexity of the metal forming dies and simplifies the forming operations such that overall cost is reduced while quality is enhanced. Further forming lower cross-member segment 77', end members segments 78' and central segment 84' as separate members also allows for using progression dies, and the like, which greatly increases efficiency of the forming operation. An additional benefit of the front frame rail assembly 26' is that the lower cross-member 77' may now be displaced laterally from end member segments 78' and central segment 84'.

As best seen in FIG. 12, end member segments 78' are formed with a forward extending flange 272 onto which mounting tab 268 is formed at its forward end. Similarly, central segment 84' is formed with a forward extending flange 274 onto which mounting surface 270 is formed at its forward end (FIG. 11). Thus, the exterior surface of lower cross-member segment 77' in a completed front frame rail assembly 26' is displaced laterally from end member segments 78' and central segment 84 while still maintaining a substantially parallel relationship thereto. Such a displaced mounting arrangement of lower cross-member segment 77' provides for maintaining the compact nature of the chair of the present invention as compared to conventional chairs while providing additional clearance between the chair frame and the leg rest frame board 48 for accommodating such features as a "pop-up" ottoman frame board (not shown) if the leg rest member is so equipped. Such additional clearance space can be seen in FIGS. 11 and 12 which clearly illustrates the displaced position of lower cross-member segment 77' with respect to central segment 84' and end member segments 78'. End member segments 78' and lower cross-member segment 77' are each formed with a plurality of apertures 90' for receiving push-in retainer clips (not shown) which extend from front tailgate 27 for mounting front tailgate 27 to front frame rail assembly 26'. To provide superior structural rigidity, lower cross-member segment 77' includes a lower horizontal flange 91' extending transversely to lower cross-member segment 77 with its opposite edge surfaces adapted to abuttingly engage the interior surfaces of end member segments forward extending flanges 272.

Front frame rail member 26 is considerably deeper in top to bottom dimension than front mechanism frame members utilized in many conventional recliner chairs. Whereas the latter may have a top to bottom dimension ranging from approximately ¾ inch to 1½ inches, front frame rail member 26 has a corresponding dimension of approximately 8 inches. This increased dimension provides a substantially broader surface for connection of front frame rail member 26 to support shaft 32 and side frame assemblies 24. When assembled, this increased connection surface results in a very rigid chair frame. In addition, the enlarged connection surface enhances the rigidity of the chair arms thereby significantly reducing any deflection of the arms due side-to-side pressure applied thereagainst. Undesirable amounts of such deflection are common in prior known recliner chairs in which the minimal connection surface between the chair arms and the front member of the mechanism frame acts like a "pivot" or "point" type connection.

With continued reference to the drawings, seat frame 44 is located between and supported for reclining movement on side frame assemblies 24. More specifically, seat frame 44 is a rigid rectangular structure having left and right side bars 93 which are rigidly secured to opposite ends of front and rear cross pieces 94 and 95, respectively. In view of the compact nature of actuation mechanism 12, seat frame 44 is non-contoured (i.e. "flat") which also permits use of loose cushions, if desired. Seat frame 44 is supported for movement relative to side frame assemblies 24 by means of a seat swing mechanism 96 for causing seat frame 44 to move substantially horizontally and slightly up or down, depending on whether seat frame 44 moves forwardly (during "reclining" movement) or rearwardly (on return to the "upright" position). Seat swing mechanism 96 includes left and right hand rear swing linkages 100 and left and right hand front slide brackets 102. Rear swing linkages 100 extend vertically well above the level of seat frame 44 along rear posts 58 of side frame assemblies 24. Each rear swing linkage 100 includes an elongated swing link 104, a support bracket 106 and a seat bracket 108. An upper end of each swing link 104 is pivotably connected just below chair arm 54 to support bracket 106 which, in turn, is fixedly secured to its corresponding side panel 50. As such, pivot points 110 between swing links 104 and support brackets 106 define a third set of "fixed" pivot or suspension points that are seated directly in side panels 50.

The lower end of each rear swing link 104 is pivoted about a pivot point 112 to an upstanding post section 114 of seat bracket 108. Seat bracket 108 has a horizontal flange portion that is securely fixed (such as by wood screws) to an underside surface of a seat side bar 93 in relatively close proximity to the back end of seat frame 44. As such, loading on the rear of seat frame 44 passes from seat brackets 108 and pivots 112 into rear swing links 104 as tension loading which is transferred by way of pivots 110 and support brackets 106 into side frame assemblies 24 of chair 10. Rear swing links 104 are elongated to provide increased leverage for balanced reclining action. Thus, the rear of seat frame 44 moves much like a controlled pendulum on and below upper pivots 110. Accordingly, seat 20 can be pre-assembled and upholstered prior to final assembly. While not considered necessary to provide superior balanced comfort, left and right tension springs (not shown) may be installed between seat bracket 108 and a rearward stationary chair frame component to provide augmented resistance to reclining movement of seat assembly 14 for heavier seat occupants.

As mentioned, seat swing mechanism 96 also includes a pair of (i.e. left and right) front slide brackets 102 which are operable to guide and limit fore and aft movement of seat frame 44 and, in turn, seat 20. More particularly, front support shaft 32 extends through lost-motion slots 116 formed in left and right slide brackets 102 which have horizontal flanges 118 securely fixed (such as by wood screws) to an underside surface of seat side bars 93 in relatively close proximity to the front end of seat frame 44. In addition, slide brackets 102 also include elongated vertical flanges 119 which are adapted to be retained against the inner side surface of seat side bars 93.

As will be appreciated, the angularity and length of slots 116 define the range of fore and aft movement of seat frame 44 relative to chair body 21 upon the seat occupant applying a force to move seat assembly 14 between the "upright" and "reclined" positions. In addition, means are also provided for generating a predetermined amount of frictional drag upon movement of seat frame 44 with respect to support shaft 32. In particular, a nylon insert 120 is fixedly retained within lost-motion slots 116. Compression springs 122 are provided which concentrically surround opposite ends of support shaft 32 for biasing a disk-like washer 124 into frictional engagement with an inner surface of nylon insert 120 adjacent slot 116. Nylon insert 120 is operable for minimizing friction resistance to movement of the front end of seat assembly 20 with respect to support shaft 32 while concomitantly acting to effectively dampen noise. Left and right spacer clips 121 are provided for preloading springs 122 and for positively locating and retaining pantographic leg rest linkages 34 on support shaft 32. Therefore, slide brackets 102, inserts 120, washers 124, springs 122 and spacer clips 121 can be pre-assembled onto support shaft 32.

Seat back 18 is constructed to include seat back frame 46 that is in the form of a rigid relatively rectangular assembly. Seat back frame 46 includes right and left hand side members 126 and upper and lower cross-pieces 128 and 130, respectively. As is known, seat back frame 46 can be removably mounted on an upper portion of rear swing links 104 by means of slide brackets 132 secured at suitable locations on side members 126. A preferred construction of slide brackets 132 for this type of mounting is shown and described in U.S. Pat. No. 5,184,871, assigned to the common assignee of the present invention, the disclosure of which is expressly incorporated by reference herein. In general, slide brackets 132 are channel-shaped to provide an interior track that slidably receives rear swing links 104 therein. When slide brackets 132 are mounted on rear swing links 104, seat back 18 is, in effect, an extension of rear swing links 104 above pivot points 110. As such, seat back 18 can be pivoted about pivots 110 for acting as a lever arm for causing relatively easy angularly movement of rear swing links 104 and fore and aft movement of seat 20.

Leg rest assembly 16 is shown to include leg rest frame board 48 having an outer surface that is padded and upholstered so that finished reclining/rocking chair 10 will be as seen in FIGS. 1A through 1D. Frame board 48 is supported and moved by identical left and right hand pantograph linkages 34. Pantograph linkages 34 are substantially identical in function and structure to that shown in FIG. 3 of U.S. Pat. No. 3,096,121, assigned to the common Assignee of the present invention, with the exception that pantograph linkages 34 are operably suspended about the second set of "fixed" suspension points defined by support shaft 32. For a better understanding of the operation of pantograph linkages 34, a brief description is included herein. More particularly, frame board 48 has an angled bracket 140 secured to its bottom face 144 for each pantograph linkage 34, whereby frame board 48 is pivotably connected at a rear pivot 146 and a front pivot 148 to one end of board links 150 and 152, respectively, of pantographs 34. The opposite end of front board link 152 is pivoted at 154 to an end of a connector link 156 which, in turn, is centrally pivoted at 158 to a portion of rear board link 150. The other end of connector link 156 is pivoted at 160 to a top end of a long support link 162. The other end of rear board link 150 is pivoted at 164 to one end of a curved link 166 which is pivoted at a central pivot 168 to a central portion of long support link 162. The other end of curved link 166 is pivotably connected at pivot 170 to front support shaft 32. As noted, left and right spring clips 121 are provided to maintain the desired spacing between left and right pantograph mechanisms 34 on support shaft 32.

Another point of support is pivot 176 at the curved bottom end of long support link 162 which connects support link 162 to a first end of a drive link 178, the other end of which has a square hole through which square drive rod 30 extends such that drive link 178 is driven by angular movement of drive rod 30. Thus, selective rotation of drive rod 30 turns drive link 178 which acts through pivot 176 to move long support link 162. Such movement of support link 162 causes curved link 166 to swing about "fixed" pivot 170 by virtue of pivot connection 168 that curved link 166 has with long support link 162. The action of link 166 swinging about fixed pivot 170 acts to move rear board link 150 outwardly and upwardly. In addition, pivot 160 at the top end of long support link 162 causes connector link 156 to swing about pivot 158 such that front board link 152 is also moved outwardly and upwardly. This extensible action takes place simultaneously with both the left hand and right hand pantograph linkages 34 when there is sufficient angular rotation of drive rod 30 via handle 42. In this manner, frame board 40 is moveable between its "stowed" vertical position and its "extend" protracted position.

As best seen in FIG. 7, drive link 178 is generally U-shaped having parallel short and long legs 182 and 184, respectively, joined by a base portion 186 which overlies drive rod 30. Both legs 182 and 184 have square aligned holes through which square drive rod 30 extends. When leg rest assembly 16 is protracted to its fully "extended" position, a cold deformed stop tab 186 on long leg 184 contacts a stop shoulder 188 formed on the lower end of long support link 162 when long leg 184 and link 162 are almost in relatively collinear alignment. Due to engagement of stop tab 186 and stop shoulder 188, further extension of pantograph linkages 34 is inhibited such that leg rest frame board 48 is held in an elevated and generally horizontal position.

To provide means for permitting the chair frame 21 to rock relative to base assembly 22, contoured rocker blocks 200 are provided which are secured to inner side faces of side panels 50. Rocker blocks 200 are positioned to engage an upper surface of base assembly 22 in a "rockable" relation therewith. Rocker blocks 200 and left and right side rails 202 of base assembly 22 are interconnected by a double coil spring "rocker" device, generally shown at 204. Preferably, rocker spring device 204 is similar to that disclosed in U.S. Pat. No. 5,171,000, commonly owned by the assignee of the present invention, and which is expressly incorporated by reference herein. As will be appreciated, rocker spring device 204 is operable to permit balanced rocking movement of chair body 21 with respect to fixed base assembly 22 without causing seat assembly 14 to recline inadvertently.

In accordance with another comfort feature associated with combination reclining/rocking chair 10, a locking apparatus 210 is provided that is operable to releasably hold chair body 21 in any one of a plurality of rearwardly "tilted" positions upon leg rest assembly 16 being selectively moved to its fully extended position. Locking apparatus 210 is also operable to inhibit subsequent rocking movement of chair body 21 in a forward direction following movement to a desired rearwardly "tilted" position. Preferably, locking apparatus 210 is a ratchet type locking mechanism that is actuated upon angular movement of drive rod 30. In general, locking apparatus 210 acts between front frame rail member 26 of chair body 21 and a forward cross rail 212 of base assembly 22 for providing a number of sequential lockable rearwardly "tilted" positions. One example of a suitable locking mechanism is thoroughly shown and disclosed in the afore-noted U.S. Pat. No. 3,096,121.

As incorporated into reclining/rocking chair 10, a contoured sector 213 is integrally formed on a vertical segment 214 of central segment 84 of front frame rail member 26 and includes a plurality of teeth 216 formed thereon. Preferably, sector 213 is formed by a pair of inwardly bent end flanges 217 of vertical segment 214 each having teeth 216 formed thereon. A latching bar or pawl 218 having an upper chisel-shaped end 220 is supported from base assembly 22 and is operable to lockingly engage sector teeth 216 for preventing forward rocking movement of chair body 21 following rearward "tilting" movement thereof. As best seen in FIG. 8, latching bar 218 has a hinged bottom end secured by a pivot 224 to a mounting bracket 226 that is securely attached to cross rail 212 of base assembly 22. A rectangular spring wire 230 has its forward web secured in a stuck-out loop 234 formed in latching bar 218. The opposite ends of spring wire 230 are overlapped and retained in an aperture extending through a cylindrical bushing 240 which is itself retained in apertures formed in opposite sides of a drive link 242. Furthermore, drive link 242 has a square aperture which receive square drive rod 30 such that drive link 242 is fixed for rotation with drive rod 30. Similarly, central member 84' of front frame rail assembly 26' includes a contoured sector 213' integrally formed on a vertical segment 214' which includes a plurality of teeth 216' formed thereon. Contoured sector 213' is similarly formed by a pair of inwardly bent end flanges 217' of vertical segment 214' each having teeth 216' formed thereon and which function similarly to teeth 216 formed on contoured sector 214 of front frame rail member 26.

With leg rest assembly 16 fully extended, rotation of actuation handle 42 in a forward direction (i.e. to retract leg rest assembly 16) causes corresponding rotation of drive link 242 which, in turn, causes spring wire 230 to be moved rearwardly for pivoting latching bar 218 in a direction toward drive rod 30. As such, chisel-shaped end 220 is withdrawn from one of teeth 216 in integral sector 213. Upon release of locking mechanism 210, chair body 21 is capable of unrestricted rocking action in a well known manner. Likewise, when actuation handle 42 is selectively rotated in a rearward direction for causing leg rest assembly 16 to move to its elevated position, rotation of drive rod 30 causes simultaneous rotation of drive link 242. This action causes wire element 230 to move forwardly for forcibly pivoting latching bar 218 and thereby advancing its chisel-shaped end 220 into locked engagement with one of teeth 216 on sector 213.

If it is desired to "tilt" chair body 21 rearwardly, chisel-shaped end 220 of latch bar 218 will sequentially ratchet over teeth 216 until the desired degree of tilt has been reached. In this manner, the rocking components of chair 10 are effectively "locked-out" for preventing chair body 21 from returning to its forward "non-tilted" position due to engagement of chisel-shaped end 220 of latching bar 218 with one of sector teeth 216. A desireable feature associated with the integration of sector 213 into front frame rail member 26 is that the noise commonly associated with "ratcheting" movement of chisel-shaped end 220 over sector teeth 216 is substantially minimized in view of less noise propagation. Moreover, when it is desired to lower the chair body to its horizontal position from a tilted position, handle 42 is forwardly rotated to withdraw chisel-shaped end 220 of latching bar 218 from sector teeth 216 for permitting chair body 21 to assume its horizontal position while concurrently causing leg rest assembly 16 to move to its "stowed" position. It is to be understood that any suitable locking device can be readily substituted for use with chair 10 of the present invention.

As best seen in FIGS. 7 and 8, left and right spring-assist toggle assemblies 36 are provided which work coactively with leg rest pantograph linkages 34. Toggle assemblies 36 provide means for securely holding frame board 48 of leg rest assembly 16 in a fully retracted position. Toggle assemblies 36 are also operable to supply a spring force for biasingly urging leg rest assembly 16 toward one of its extended and retracted positions. More particularly, toggle assemblies 36 each include a toggle lever 252 with a square hole which is mounted by means of the square hole on square drive rod 30 for rotation therewith. Toggle lever 252 is pivotally connected at pivot 253 to front leg 254 of a C-shaped toggle link 256 that curves around, above and to the rear of drive rod 30 where its rear leg 258 has an opening to which one end of a helical coil spring 262 is attached. The opposite end of spring 262 is attached to a spring pin 264 which is secured to a rearward portion of rocker blocks 200. While not shown, tension adjustment means may be optionally provided for adjusting the tension in spring 262. For example, the tension in spring 262 can be adjustably relieved for a lighter weight occupant or it can be increased for a heavier seat occupant. Each C-shaped toggle link 256 of toggle assemblies 36 is positively located on drive rod 30 by means of a spacer clip 265 for maintaining the desired spacing of toggle links 256 from rocker blocks 200 and rocker devices 204 in order to avoid interference therewith. As shown in FIG. 7, spacer clips 265 also positively locate leg rest drive links 178 in their desired position along drive rod 30.

Operation of toggle assemblies 36 will now be described in greater detail. The location of pivot 253 below drive rod 30 and the line of action of spring 262 are such that in the retracted position of leg rest assembly 16, the spring force acts to biasingly hold or "retain" leg rest assembly 16. As leg rest 16 is initially extended upon slight rotation of actuator lever 42 and, in turn, drive rod 30, pivot 253 moves up and over center of an imaginary line between the axis of spring pin 264 and the drive rod axis. Once pivot 253 is over-center, tension loading on spring 262 assists in drivingly rotating drive rod 30 for elevating leg rest assembly 16 as rear leg 258 of C-shaped link 256 is pulled toward spring pin 264. In addition, spring 262 assists the seat occupant in pivoting handle 42 through the required actuation angle. In similar fashion, toggle assembly 36 is adapted to utilize the spring biasing force of spring 262 to assist in returning leg rest assembly 16 to its stowed position upon reverse rotation of handle 42.

In accordance with the principles of the present invention, a unique method for assembling the various "modular" pre-assembled frame components and actuation mechanism 12 into reclining/rocking chair 10 will now be described in greater detail. In addition, the improved method of the present invention permits sequential assembly of the pre-assembled and/or upholstered components in a simple and efficient manner for significantly reducing overall system complexity, weight, and cost while promoting superior quality and reliability.

Figure 9A:
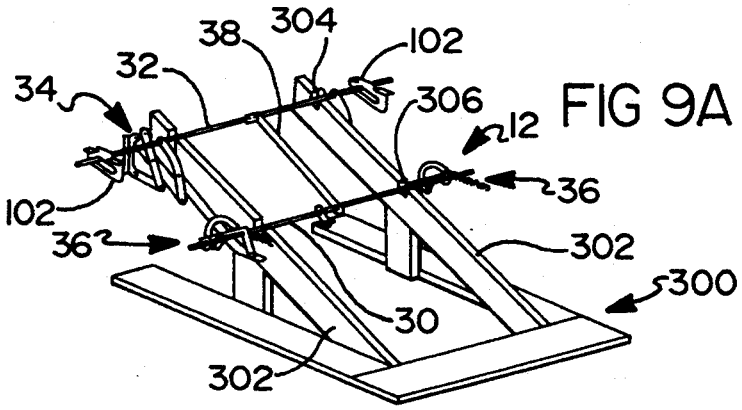
FIGS. 9A through 9H are various perspective views provided to illustrate one preferred method for assembling the reclining chair apparatus of FIGS. 1 and 2.

With particular reference now to FIG. 9A, pre-assembled actuation mechanism 12 is shown retained on a suitable holder or "jig" 300. Jig 300 includes a pair of spaced and angularly extending stantions 302 having first and second sets of aligned notches 304 and 306, respectively. As can be seen, the first set of aligned notches 304 is provided for retaining support shaft 32 therein while the second set of aligned notches 306 is provided for retaining drive rod 30 therein. As previously noted, the various components associated with slide brackets 102, pantograph linkages 34, drive link 242, cross-brace 38, and toggle assemblies 36 are all operably coupled to, or suspended from, actuation mechanism 12 prior to interconnection with the various frame components. Alternatively, jig 300 may be used as an appropriate situs for assembling the various linkages and components associated with actuation mechanism 12.

Figure 9B:
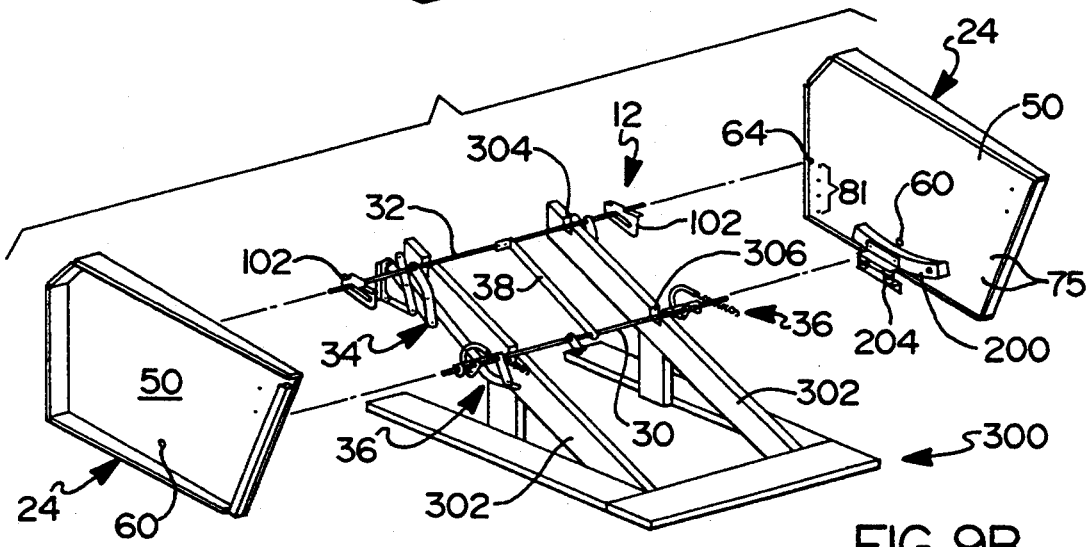

With reference now to FIG. 9B, the assembly step for orienting and interconnecting side frame assemblies 24 with actuation mechanism 12 is clearly shown. As will be appreciated, side frame assemblies 24 have been pre-assembled to include rocker blocks 200, spring pins 264, and rocker spring devices 204. While not shown, it is to be understood that the requisite padding, lining, decorative upholstery and the like have also been installed on side frame assemblies 24 prior to assembly with actuation mechanism 12. As seen, drive rod 30 and support shaft 32 are of sufficient length such that side frame assemblies 24 can be retained thereon. More specifically, the upholstered side frame assemblies 24 are positioned on actuation mechanism 12 such that the opposite ends of drive rod 30 extend through the first set of aligned bores 60 formed in side panels 50 (i.e. the first set of "fixed" pivot points). Similarly, the opposite ends of support shaft 32 are seated with the second set of aligned bores 64 formed in side panels 50 (i.e. the second set of "fixed" pivot points).

Figure 9C:
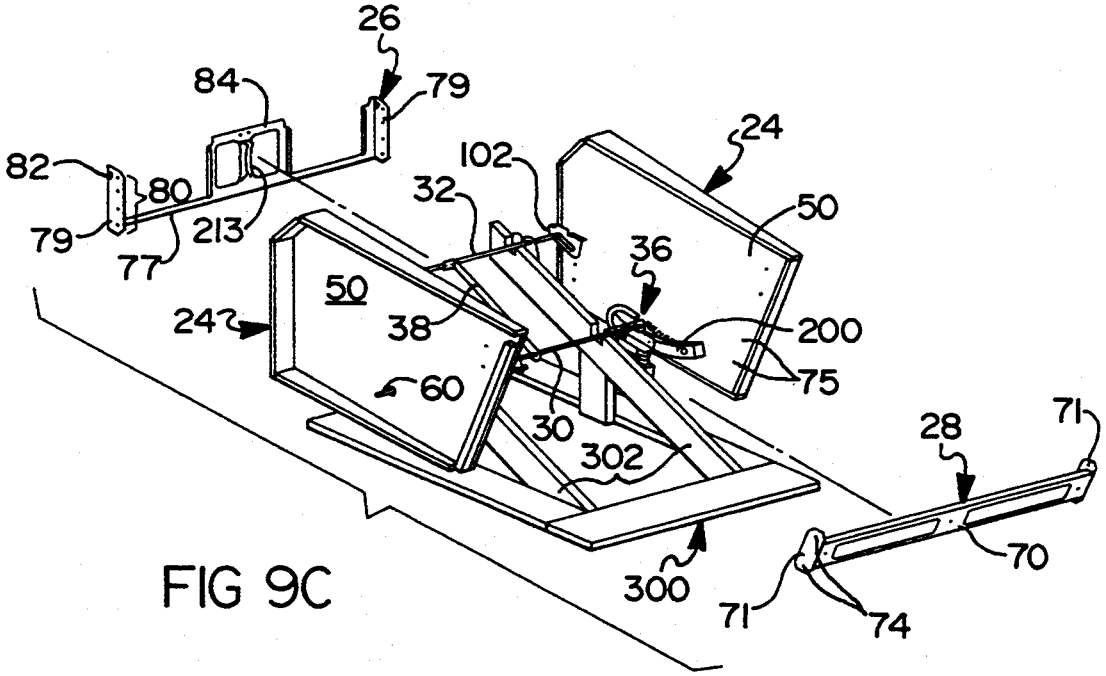

As seen in FIG. 9C, the four primary frame components include left and right side frame assemblies 24 and front and rear frame rail members 26 and 28, respectively. In accordance with one preferred assembly procedure, upon aligning and locating rear frame rail member 28 with respect to the left and right side frame assemblies 24, threaded fasteners are threadably driven through bores 74 in angled bracket segments 71 and into bores 75 formed of side panels 50 for securing rear frame rail member 28 between the left and right side frame assemblies 24. Complete tightening of the threaded fasteners is typically deferred until front frame rail member 26 has also been secured to side frame assemblies 24. As noted, an upholstered rear "tailgate" (not shown) is preferably secured to rear frame rail member 28 in those applications wherein rear frame rail assembly 28 is not upholstered.

Following interconnection of rear frame rail member 28, one end of support shaft 32 is removed from its alignment bore 64 such that it may be slid through one guide slot 82 of front frame rail member 26 and then re-inserted into its bore 64 in side frame assembly 24. Thereafter, front frame rail member 26 is slid inwardly along support shaft 32 to permit the opposite end of support shaft 32 to be slidably inserted through the opposite guide slot 82 in a similar fashion. Thereafter, bores 80 formed in flanged bracket segments 79 are aligned with alignment bores 81 formed in side panels 50 such that threaded fasteners are thereafter driven through bores 80 and 81 for rigidly securing front frame rail member 26 to side frame assemblies 24. The four pre-drilled bores (not shown) in support shaft 32 are then aligned with bores 83 in end segments 78 and bores 88 in central segment 84 for fixing front frame rail member 26 to support shaft 32. As noted, cross-brace bracket 39 is also securely attached to support shaft 32 and front frame rail member 26 via bores 88 in central segment 84 to provide additional structural rigidity. Thereafter, upholstered front "tailgate" 27 is secured to front frame rail member 26 in those applications wherein front frame rail assembly 26 is not pre-upholstered.

As an alternative to the method illustrated in FIGS. 9A through 9C for suspending actuation mechanism 12 from side frame assemblies 24 prior to installation of front frame rail member 26, it is contemplated that front frame rail member 26 can be pre-assembled onto support shaft 32 prior to assembly of side frame assemblies 24 onto actuation mechanism 12. In general, an intermediate assembly operation would be performed between the sequence of assembly operations shown in FIGS. 9A and 9B for initially suspending front frame rail member 26 from support shaft 32. More specifically, a guide slot 82 in one bracket segment 79 could be slid over a first end of support shaft 32 for suspending its respective end segments 78 therefrom. Thereafter, the opposite end of support shaft 32 is inserted through the guide slot 82 in the opposite bracket segment 79 for supporting a second end segment 78 from support shaft 32. Thereafter, side panels 50 can be installed on drive rod 30 and support shaft 32 such that opposite ends of drive rod 30 are disposed in the first set of aligned side panel bores 60 and the opposite ends of support shaft 32 are seated within the second set of aligned side panel bores 64. Next, threaded fasteners are driven through bores 80 in bracket segments 79 and into bores 81 in side panels 50 for fixing front frame rail member 26 to side frame assemblies 24. Obviously, such fastening of front frame rail member 26 could be performed prior to, or after, rear frame rail member 28 is secured to side frame assemblies 24. Following attachment of front frame rail member 26 to side frame assemblies 24, the pre-drilled bores in support shaft 32 are aligned with bores 83 and 88 in front frame rail member 26 for receipt of the threaded fasteners required for fixing front frame rail member 26 directly to support shaft 32. Thus, according to either of the two alternative assembly methods disclosed, front frame rail member 26 is "suspended" from support shaft 32 prior to interconnection therewith and with side panels 50.

Figure 9D:
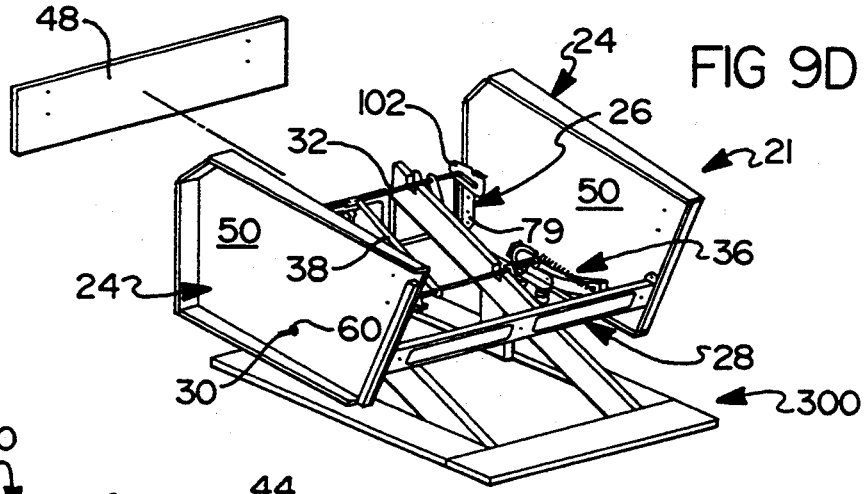

FIG. 9D illustrates the integrated and interdependent relationship of the four primary frame components which, when assembled, define an extremely rigid "box-like" upholstered chair body 21 within which actuation mechanism 12 is suspended. As noted, this "integrated" construction permits the elimination of the separate mechanism frame assembly conventionally provided for supporting the actuation mechanisms in prior known reclining chairs. As seen, jig 300 is designed to permit the various frame components to be interconnected in an extremely efficient manner. Following assembly of chair body 21, frame board 48 is fixedly secured to angled brackets 140 of pantograph linkages 34. Again, it is to be understood that frame board 48 has been pre-assembled as an upholstered unit prior to being assembled as part of chair body 21.

Figure 9E:
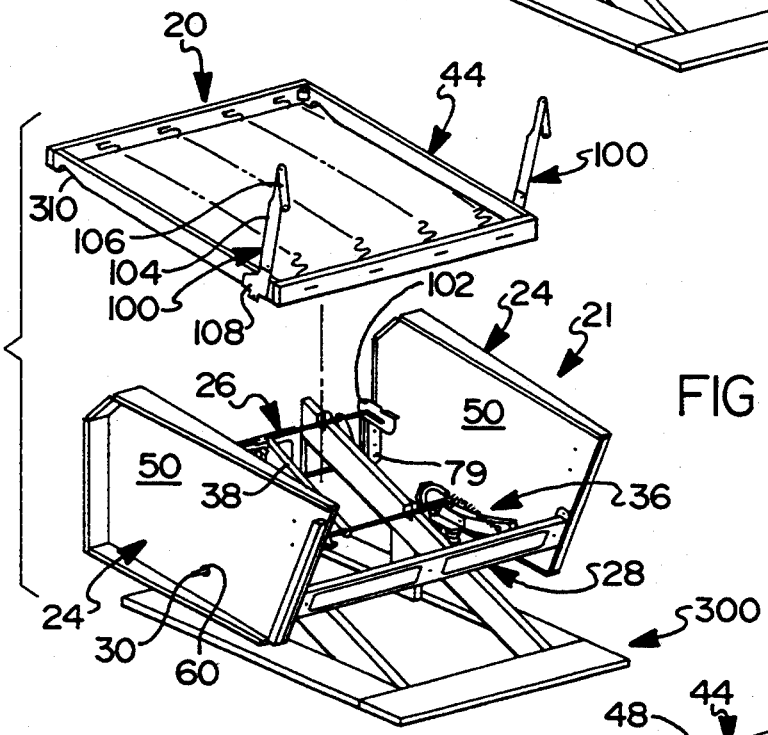

With particular reference now to FIG. 9E, the four frame components defining chair body 21 are shown supported from jig 300 with actuation mechanism 12 integrally suspended therefrom. In accordance with the next operation, upholstered seat 20 (which includes seat frame 44 with its appropriate upholstery padding and springs) is interconnected to chair body 21. More particularly, notches 310 formed in the front underside edges of seat frame side bars 93 are provided for aligning seat frame 44 with respect to support shaft 32. Next, rear swing linkages 100, which have been pre-assembled onto upholstered seat 20, are fixedly secured to side panels 50 via support brackets 106. Once support brackets 106 are fixedly secured to side panels 50 (via suitable fasteners), pivot points 110 between swing links 104 and support brackets 106 are operable to define the third set of "fixed" pivot points about which seat assembly 14 is reclinable. Alternatively, support brackets 106 of rear swing linkages 100 can be initially mounted directly to side panels 50 such that angled brackets 108 can be thereafter secured to upholstered seat 20. In this manner, seat 20 can be "flipped over" to permit seat brackets 108 to be securely fastened to side bars 93 of seat frame 44. With seat frame 44 positioned such that support shaft 32 is located in notches 310, slide brackets 102 are pulled inwardly against the biasing force of springs 122 until vertically extending flanges 119 abuttingly engage the inner surface of seat frame side bars 93. Thereafter, suitable fasteners (such as wood screws) are driven through holes in horizontal flanges 118 to securely fix slide brackets 102 to an underside surface of seat side bars 93.

Figure 9F:
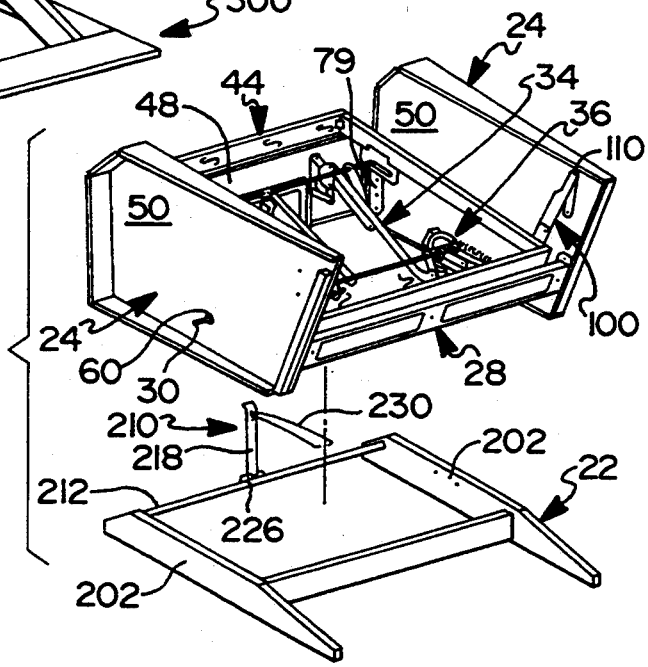
Figure 9G:
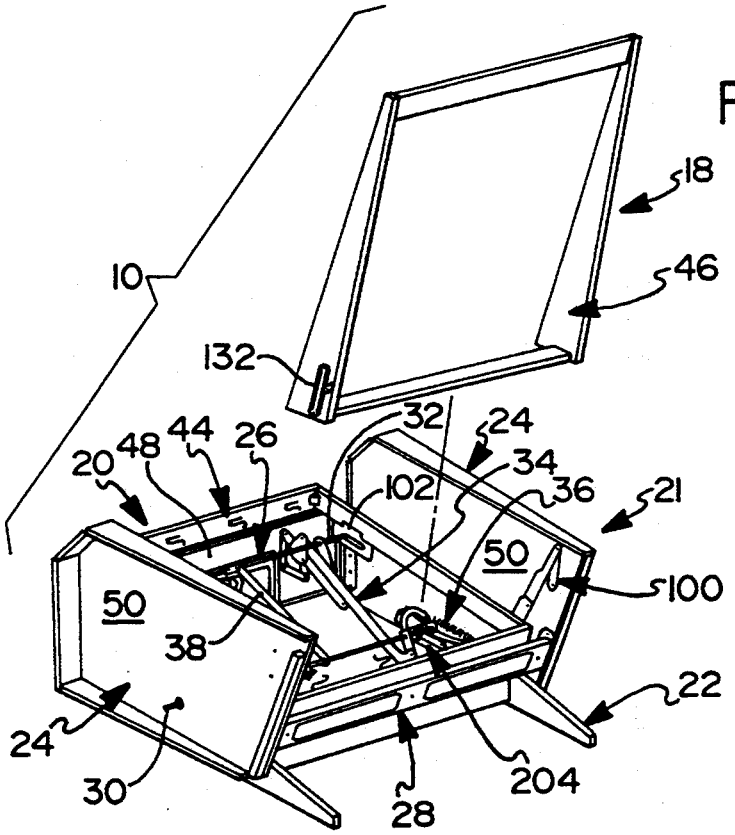
Figure 9H:
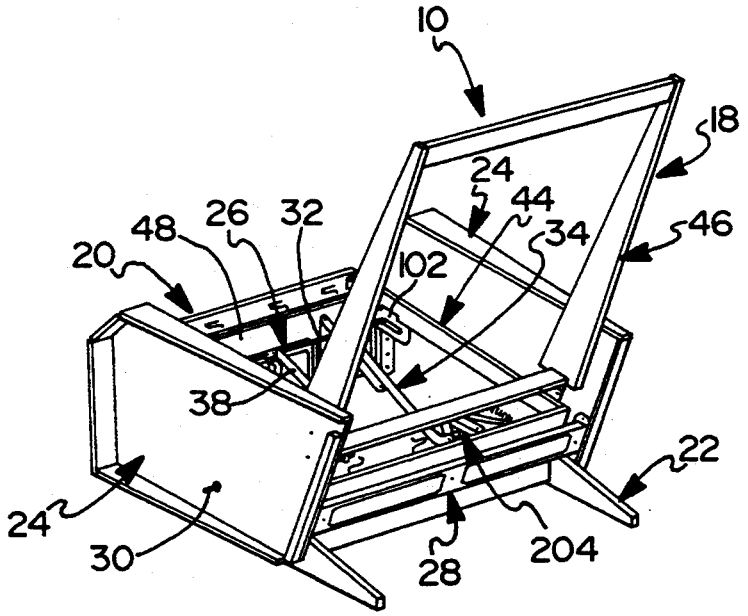

With particular reference now to FIG. 9F, base assembly 22 is shown pre-assembled to include various components of locking apparatus 210 such as latch bar 218 and mounting bracket 226 secured to front cross rail 212 of base assembly 22. Chair body 21 is removed from jig 300 and is placed in proper alignment with respect to base assembly 22 such that rocker blocks 200 rest on side rails 202 of base assembly 22. Thereafter, rocker spring devices 204, shown in FIG. 9B preassembled to extend downwardly from rocker blocks 20, are fixedly secured to the inner face surfaces of side rails 202 of base assembly 22 via suitable fasteners. Next, the opposite ends of spring wire 230 are secured to drive link 242 for completing the operative assembly of locking mechanism 210. Finally, FIGS. 9G and 9H illustrate the manner in which upholstered seat back 18 can be detachably secured to seat 20 via swing links 104 and slide brackets 132.

As is relatively apparent from examination of FIGS. 9A through 9H, the pre-assembled components can be interconnected in a number of other acceptable sequential operations to produce "knock-down" or modular chair 10. The method of assembly disclosed herein is advantageous in that virtually all of the components can be pre-assembled "off-line" for quick and efficient modular interconnection in a highly repeatable and precise fashion.

The foregoing discussion discloses and describes an exemplary embodiment of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A method for assembling a reclining chair comprising:

providing means defining a chair frame having side frame members interconnectable with a cross rail assembly and a cross rail member;

suspending said cross rail assembly from an actuation mechanism;

suspending said actuation mechanism between said side frame members;

interconnecting said cross rail assembly and said cross rail member with said side frame members;

pivotally interconnecting a seat and seat back; and operably connecting said interconnected seat and seat back to said chair frame for reclining movement.

2. The method of claim 1 further comprising:

connecting said seat to said actuation mechanism for guiding the longitudinal movement of said seat in response to said reclining movement of said seat assembly.

3. The method of claim 1 wherein said step of suspending said first cross rail assembly comprises:

providing support means associated with said actuation mechanism for supporting said cross rail assembly; and installing said cross rail assembly on said support means.

4. The method of claim 3 wherein said first cross rail assembly includes a set of alignable guide apertures, said support means comprises a first shaft, and said step of installing said cross rail assembly comprises inserting opposite ends of said first shaft within said first set of alignable guide apertures.

5. The method of claim 4 wherein said step of suspending said cross rail assembly is performed prior to said step of suspending said actuation mechanism.

6. The method of claim 5 wherein said first cross rail assembly is a non-wooden front frame rail assembly having a lower cross segment and a pair of end segments rigidly secured to said lower cross segment and extending upwardly from said lower cross segment, said end segments having a bracket segment formed transversely thereto and having said guide apertures and mounting apertures formed therein, and wherein said step of interconnecting said cross rail assembly comprises driving fasteners through said mounting apertures and into said side frame members.

7. The method of claim 6 further comprising the step of interconnecting said front frame rail assembly to said first shaft such that said first shaft acts as an upper cross segment at a front portion of said chair frame.

8. The method of claim 7 further comprising the step of installing an upholstered trim panel on said front frame rail assembly.

9. A reclining chair comprising:

an actuation mechanism suspended between a pair of side frame members;

a front cross rail assembly suspended from said actuation mechanism and interconnected to a front portion of said side frame members;

a rear cross rail member interconnected to a rear portion of said side frame members to define a chair frame within which said actuation mechanism is operably supported;

a seat assembly having a seat, a seat back, and swing link means for pivotally interconnecting said seat back and said seat;

means for connecting said swing link means to said side frame members for suspending said seat assembly therebetween, said swing link means operable to permit reclining movement of said seat assembly with respect to said chair frame between an upright position and a reclined position in response to pressure applied by a seat occupant to said seat back; and means for connecting said seat to said actuation mechanism for guiding the longitudinal movement of said seat in response to said reclining movement of said seat assembly.

10. The reclining chair of claim 9 wherein said actuation mechanism includes a support shaft and said cross rail assembly has a set of alignable guide apertures adapted to receive opposite ends of said support shaft therein.

11. The reclining chair of claim 10 wherein said front cross rail assembly comprises an assembly of metal frame components having a lower cross segment and a pair of end segments rigidly secured to said lower cross segment and extending upwardly therefrom, said end segments having a transverse bracket segment on which said guide apertures are formed, said bracket segments each having a set of mounting apertures adapted to receive fasteners, therethrough for interconnecting said front cross rail assembly to said side frame members.

12. The reclining chair of claim 11 wherein said front cross rail assembly further comprises a central segment rigidly secured to said lower cross segment and extending upwardly from said lower cross segment and having a second set of mounting apertures for fixing said central segment to a central portion of said support shaft.

13. The reclining chair of claim 12 wherein said front cross rail assembly further comprises attachment means for permitting an upholstered trim panel to be fixedly secured thereto.

14. A reclining chair comprising:

an actuation mechanism having first and second shafts;

a chair frame having side frame members interconnectable to a front cross frame assembly and a rear cross frame member, wherein said front cross frame assembly and said rear cross frame member are metal;

a seat assembly including a seat back, a seat member, and swing linkage means for pivotably interconnecting said seat member and seat back to permit reclining movement therebetween in response to pressure applied by a seat occupant to said seat back;

means for connecting said swing linkage means to said side frame members;

guide means for permitting fore and aft longitudinal movement of said seat member with respect to said chair frame, said guide means being operably associated with said first shaft for defining the limits of said fore and aft movement of said seat members; and detachable means for securing said seat back to said swing linkage means such that said seat back and seat member are movable between an upright position and a reclined position.

15. The reclining chair of claim 14 wherein said first cross frame assembly has a set of alignable guide apertures adapted to receive opposite ends of said first shaft therein.

16. The reclining chair of claim 15 wherein said front cross frame assembly comprises an assembly having a lower cross segment and a pair of end segments rigidly secured to said lower cross segment and extending upwardly therefrom, said end segments having a transverse bracket segment on which said guide apertures are formed, said bracket segments each having a set of mounting apertures adapted to receive fasteners therethrough for interconnecting said front cross frame assembly to said side frame members.

17. The reclining chair of claim 16 wherein said front cross frame assembly further comprises a central segment rigidly secured to said lower cross segment and extending upwardly from said lower cross segment and having a second set of mounting apertures for fixing said central segment to a central portion of said first shaft.

18. The reclining chair of claim 17 wherein said front cross frame assembly further comprises attachment means for permitting an upholstered trim panel to be fixedly secured thereto.

* * * * *